US005305976A

United States Patent [19]

Blanchard

[11] Patent Number: 5,305,976

[45] Date of Patent: Apr. 26, 1994

[54] STAKE SUPPORTED POST

[75] Inventor: Jack D. Blanchard, 1618 E. Lassen Ave., Chico, Calif. 95926

[73] Assignee: Jack D. Blanchard, Chico, Calif.

[21] Appl. No.: 973,278

[22] Filed: Nov. 9, 1992

[51] Int. Cl.[5] ..... A45F 3/44

[52] U.S. Cl. ..... 248/156; 40/607; 248/508; 248/530; 248/545

[58] Field of Search ..... 248/156, 508, 507, 545, 248/530, 532, 533; 40/607; 52/153

[56] References Cited

U.S. PATENT DOCUMENTS 4,249,715 2/1981 Repp ..... 248/156 X
4,483,506 11/1984 Litwiller ..... 248/545
4,524,533 6/1985 Still, Jr. ..... 248/156 X
4,790,092 12/1988 Farmer ..... 40/607
4,843,746 7/1989 DesNoyers ..... 40/607
4,910,901 3/1990 Boyar ..... 40/607
5,082,231 1/1992 Knowles ..... 248/156 X
5,181,335 1/1993 Todd ..... 248/156 X

*Primary Examiner*—Ramon O. Ramirez

[57] ABSTRACT

A metal stake having a pointed lower end is arranged for penetration into and upright support above the ground. At least one plate extends laterally from the stake to preclude turning thereof and also can enter a slot in a wooden post to enable removable post mounting on the stake. With slight addition of square collars a square tubular post can be similarly mounted.

1 Claim, 1 Drawing Sheet fig_1
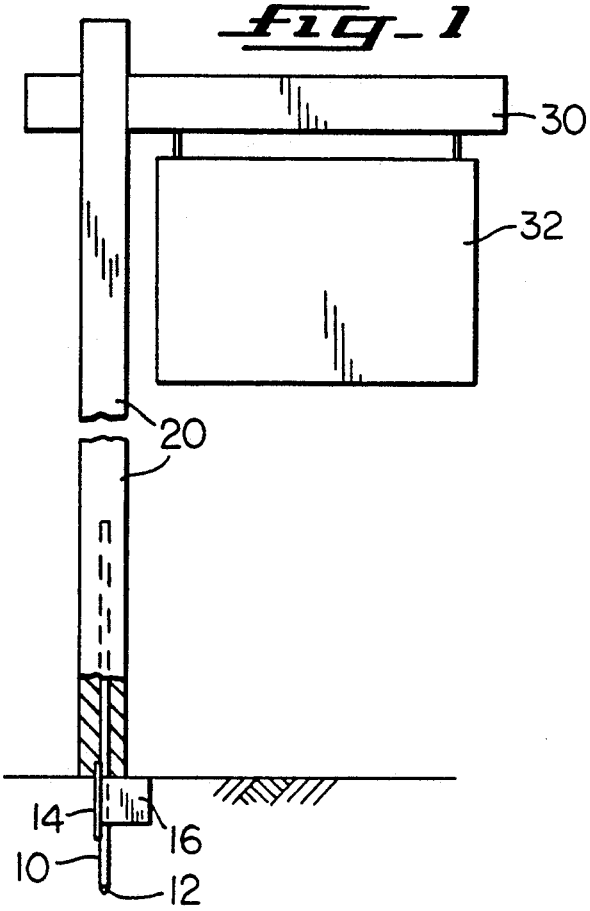
fig_2
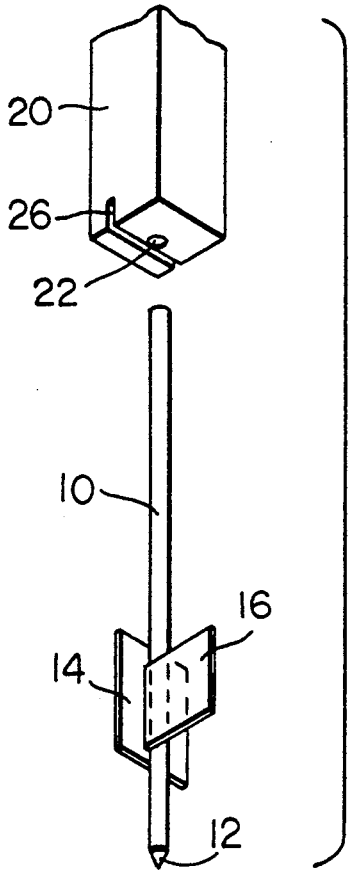
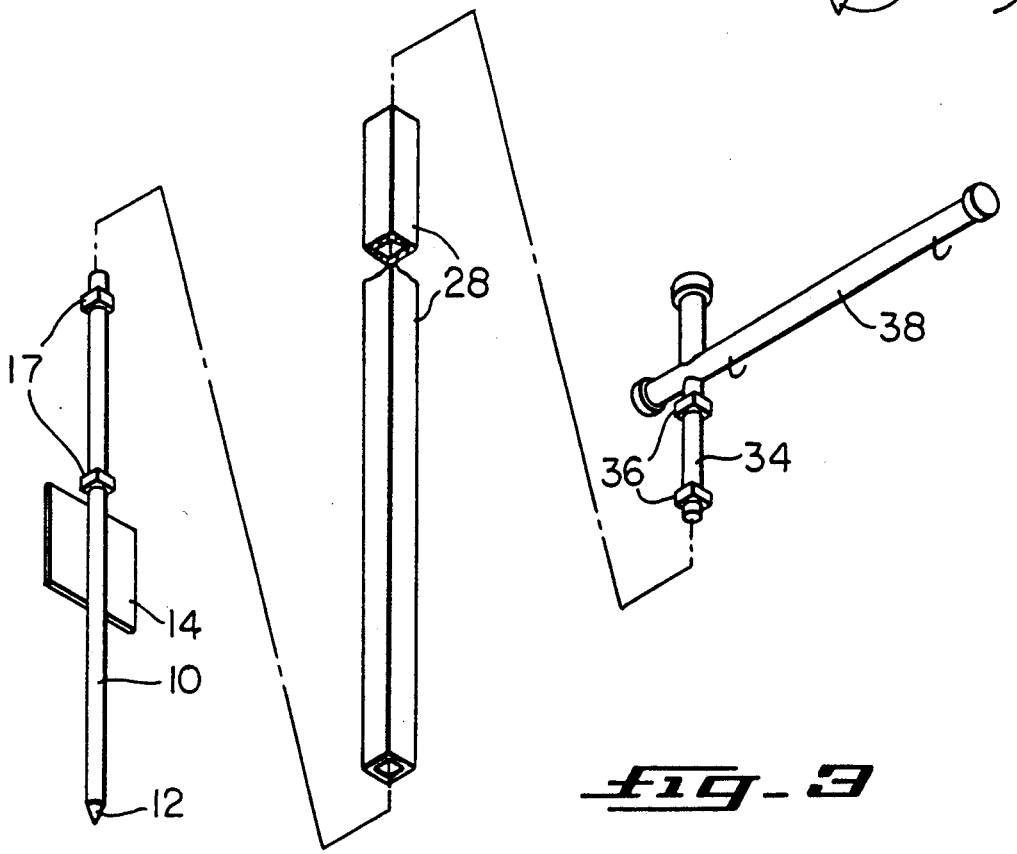
fig_3

STAKE SUPPORTED POST

FIELD OF THE INVENTION

The present invention relates to posts for supporting signs or the like and more particularly to a post supporting stake arranged for earth penetration.

BACKGROUND OF THE INVENTION

Real estate and other signs are frequently mounted in the earth in front of a home or other appropriate locations. They are mounted on a post most commonly composed of wood which deteriorates with soil contact. Furthermore considerable effort is required to dig a hole in the earth for installation and if the post is not securely embedded, it may well blow down in a storm.

SUMMARY OF THE PRESENT INVENTION

Accordingly it is the general objective of the present invention to provide thin, rigid metal stake that can be easily inserted in the earth and removably carry a generally upright sign post or the like thereon at a position above soil contact.

To achieve such objective, the stake is a rigid but relatively thin unit, having one end pointed to facilitate entry into the earth by mere pounding thereof, in a substantially vertical position. One or more thin plates are attached to the stake to extend laterally therefrom in one or more different planes which includes the metal stake itself, at least one plate having its upper end above ground level.

A post of metal, plastic, or wood is formed to telescope over the upper end of the stake so as to rise substantially vertically therefrom. In the case of wood, such removable connection is made by centrally boring a hole therein for reception of the upper end of the stake and cutting a slot for reception of the plate on the stake.

By adding spaced square collars adjacent the upper portion of the stake, a square tube composed of metal or plastic can form the attached post.

In either case a lateral bracket can be secured to the upper end of the post to suspend a sign therefrom.

BRIEF DESCRIPTION OF THE DRAWING

The stated objective of the invention and the manner in which it is achieved as summarized above, will be more fully understood by reference to the following detailed description of two embodiments of the invention shown in the accompanying drawing wherein:

FIG. 1 is a side elevational view of a conjoined post and stake in use for support of a sign, a portion being broken away to show certain details, FIG. 2 is an exploded perspective view of the FIG. 1 unit prior to assembly, and FIG. 3 is an exploded perspective view of a modified embodiment of the invention.

DETAILED DESCRIPTION OF THE ILLUSTRATED EMBODIMENTS OF THE INVENTION

With initial reference to FIGS. 1 and 2, the illustrated embodiment of the invention includes a thin elongated rigid metal stake 10 having a lower pointed end 12 enabling easy penetration into the soil as shown in FIG. 1 to removably support the stake in an upright substantially vertical position.

A pair of thin rigid metal plates 14, 16 are welded to the stake adjacent its lower end to extend laterally therefrom in mutually perpendicular planes each of which includes the stake 10, one plate 14 extends upwardly above the other plate 16 and is arranged to enter a slot 26 in the bottom of a wooden post 20. The post 20 also has a central hole 22 which closely accommodates the upper portion of the stake so the post 20, when assembled as shown in FIG. 1 will assume an upright substantially vertical position. The bottom of the post 20 will be at ground level as shown in FIG. 1.

A wooden bracket 30 extends laterally from the top of the post 20 and suspends a sign 32 in a conventional fashion.

With but slight modification the stake 10 can be arranged to support other posts. As shown in FIG. 3, the post 10 with a plate 14 and lower pointed end which corresponds to that shown in FIGS. 1 and 2 has added to its upper end at spaced intervals a pair of square collars 17 dimensioned to receive a square tubular post 28 composed of metal or plastic. The post 28 receives an extension 34 with square collars 36 dimensioned for reception therewith. The extension 34 in turn, mounts a lateral bracket 38 which can suspend a sign or the like as shown in FIG. 1.

Yet other modifications or alterations can be made without departing from the spirit of the invention, and the foregoing description of two embodiments is to be considered as purely exemplary and the actual scope of the invention is indicated only by reference to the appended claims.

What is claimed is:

1. A post for supporting signs (or the like) which comprises a metal stake having at least one plate extending laterally therefrom in a plane including said stake enabling earth penetration and a substantially upright wooden post having an interior opening removably encompassing said stake and a slot encompassing said plate.

* * * * *